US006836625B2

(12) United States Patent
Shiratori

(10) Patent No.: US 6,836,625 B2
(45) Date of Patent: Dec. 28, 2004

(54) COLOR IMAGE FORMING APPARATUS AND CONTROL METHOD THEREFOR

(75) Inventor: Katsuhito Shiratori, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/630,728

(22) Filed: Jul. 31, 2003

(65) Prior Publication Data

US 2004/0028421 A1 Feb. 12, 2004

(30) Foreign Application Priority Data

Aug. 6, 2002 (JP) ..... 2002-228077

(51) Int. Cl.[7] ..... G03G 15/00
(52) U.S. Cl. ..... 399/49
(58) Field of Search ..... 399/49, 68, 74, 399/38, 41

(56) References Cited

U.S. PATENT DOCUMENTS

| | | | | |
|---|---|---|---|---|
| 5,963,756 | A | 10/1999 | Sakai et al. | 399/39 |
| 6,070,022 | A | 5/2000 | Kobayashi et al. | 399/12 |
| 6,172,771 | B1 | 1/2001 | Ikeda et al. | 358/406 |
| 6,181,892 | B1 * | 1/2001 | Fujimori | 399/49 |
| 6,185,386 | B1 | 2/2001 | Noguchi | 399/49 |
| 6,215,562 | B1 | 4/2001 | Michel et al. | 358/1.9 |
| 6,731,889 | B2 * | 5/2004 | Nakayama | 399/49 |
| 2003/0049040 | A1 | 3/2003 | Tezuka et al. | 399/49 |
| 2003/0085941 | A1 | 5/2003 | Tezuka et al. | 347/19 |
| 2003/0090693 | A1 | 5/2003 | Tezuka et al. | 358/1.9 |
| 2003/0091357 | A1 | 5/2003 | Maebashi et al. | 399/49 |

FOREIGN PATENT DOCUMENTS

| | | |
|---|---|---|
| WO | WO 93/20648 | 10/1993 |

* cited by examiner

*Primary Examiner*—Susan Lee
(74) *Attorney, Agent, or Firm*—Fitzpatrick, Cella, Harper & Scinto

(57) ABSTRACT

The color image forming apparatus is provided, which includes a color sensor and conducts color correction. In the color image forming apparatus, a patch of a color matching chart obtained by a color sensor is detected in accordance with a conveying speed (a standard speed mode, a half speed mode, a high gloss mode, or the like) to thereby make a color correction table. Further, upon printing, the color correction table made in accordance with the conveying speed is used to perform image forming. Accordingly, images outputted at different conveying speeds can have the same colors.

8 Claims, 10 Drawing Sheets

COLOR IMAGE FORMING APPARATUS AND CONTROL METHOD THEREFOR

BACKGROUND OF THE INVENTION

1. Field of the Invention

The present invention relates to a color image forming apparatus of an electrophotographic process such as a color printer or a color copying machine, and more particularly to a control of characteristics of a density or a gradation of an image in the apparatus.

2. Related Background Art

In recent years, demand has been growing for a higher quality image that is outputted from a color image forming apparatus employing an electrophotographic process, an ink jet process, or the like, such as a color printer or a color copying machine. In particular, a gradation of an image density and its stability greatly affect judgment as to whether a human considers an image to be good or bad.

However, if respective parts of the color image forming apparatus vary according to environmental variation or long-term use, the density of an obtained image varies as well. Especially the color image forming apparatus of an electrophotographic process may lose a color balance because the density of the obtained image varies due to even slight environmental variation, thereby making it necessary for the color image forming apparatus to include means for maintaining constant characteristics of a relationship between a density and a gradation all the time. Therefore, several kinds of exposure amounts according to an absolute humidity, process conditions including a developing bias, and gradation correcting means including a look-up table (LUT) are provided for toner of each color. Based on the absolute humidity measured by a hygrothermal sensor, the process conditions at that time and optimal values for gradation correction are selected.

Also, in order to obtain the constant characteristics of the relationship between a density and a gradation even upon variation of the respective parts of the color image forming apparatus, a density detecting toner patch is formed using the toner of each color on an intermediate transferring body, a drum, or the like. A density of the unfixed toner patch is then detected by an unfixed toner density detecting sensor (hereinafter, referred to as "density sensor"). Density control is performed by feeding back the detection results to the exposure amounts and the process conditions including a developing bias, thereby attaining a stable image.

The above-mentioned density control using the density sensor is performed by forming a patch on an intermediate transferring body, a drum, or the like for detecting the density, but not for controlling variation in the color balance of the image transferred onto and fixed to a transfer material. The color balance also varies according to transferring efficiency upon transferring of a toner image onto a transfer material, and according to heating and pressurizing upon fixing. The variation cannot be coped with by the density control using the density sensor.

It is therefore conceivable to provide a color image forming apparatus equipped with a sensor for detecting a patch color on a transfer material (hereinafter, referred to as "color sensor"). The color image forming apparatus is adapted to form on a transfer material a gray gradation patch using black (K) (hereinafter, referred to as "gray gradation patch") and a gray gradation patch in process print using color mixture of cyan (C), magenta (M), and yellow (Y) (hereinafter, referred to as "process gray gradation patch") and to compare colors of the two patches after the fixing, thereby enabling an output of such a CMY mixing proportion as to cause the process gray gradation patch to be of an achromatic color.

According to this color image forming apparatus, the detection results are fed back to exposure amounts and process conditions of an image forming part, a color matching table for converting an RGB signal from an image processing part into a color gamut of a color image forming apparatus, a color separation table for converting an RGB signal into a CMYK signal, a calibration table for correcting characteristics of a relationship between a density and a gradation, and the like. Accordingly, control of a density or chromaticity of an final output image formed on the transfer material can be performed.

The control can be performed similarly by detecting the output image from the color image forming apparatus using an external image reading apparatus, a chromascope, or a densitometer. However, the above-mentioned method using the color sensor is superior in that the control completes only in a printer. The color sensor includes, for example, a light emitting element that uses three or more light sources having different emission spectra such as red (R), green (G), and blue (B). Alternatively, the color sensor includes a light emitting element that uses a light source emitting a white color (W), and a light receiving element on which three or more kinds of filters having different spectral transmittances such as red (R), green (G), and blue (B). By the above arrangement, three or more different kinds of outputs including an RGB output can be obtained.

According to a conventional image forming apparatus, the above-mentioned control using the color sensor has been performed at a single conveying speed, that is, in a standard speed mode suitable for conveying a sheet of plain paper. However, in different speed modes such as a so-called half speed mode suitable for conveying a cardboard and a low speed mode suitable for effecting a high gloss, there occur differences in fixing property of toner (a gloss of a transfer material surface) and transferring efficiency (an amount of toner transferred onto a transfer material) between each mode, so that the color balance of the final output image may vary.

SUMMARY OF THE INVENTION

The present invention has been made in view of the above circumstances, and therefore has an object to provide a color image forming apparatus that uses a combination of a color sensor and a density sensor, in which a density is controlled at each conveying speed of a transfer material, thereby making it possible to attain a stable color balance at any conveying speed.

It is another object of the present invention to provide a color image forming apparatus, including:

an image processing part that is suitable for processing image data based on a calibration table;

a plurality of image forming parts that are suitable for forming an image using different colors from each other based on the image data outputted from the image processing part;

a conveying part that can convey at any one of a plurality of speeds a transfer material onto which the image formed by the plurality of image forming parts is transferred;

a fixing part that is suitable for subjecting the transfer material conveyed by the conveying part to fixing processing;

a first detecting part that is suitable for detecting a density of a patch formed by the plurality of image forming parts, the patch being unfixed;

a second detecting part that is suitable for detecting a chromaticity of the patch formed by the plurality of image forming parts, the patch being fixed; and a setting part is suitable for revising the calibration table of the image processing part based on a detection result of the first detecting part and a detection result of the second detecting part, in which:

the image processing part stores the calibration table corresponding to each of the plurality of speeds; and the setting part sets the calibration table corresponding to each of the plurality of speeds based on the detection result of the first detecting part and the detection result of the second detecting part.

It is further another object of the present invention to provide a control method for a color image forming apparatus that includes:

an image processing part that is suitable for processing image data based on a calibration table;

a plurality of image forming parts that are suitable for forming an image using different colors from each other based on the image data outputted from the image processing part;

a conveying part that can convey at any one of a plurality of speeds a transfer material onto which the image formed by the plurality of image forming parts is transferred; and a fixing part that is suitable for subjecting the transfer material conveyed by the conveying part to fixing processing, the image processing part storing the calibration table corresponding to each of the plurality of speeds, the control method including:

a first detecting step of detecting by a first detecting part a density of a patch formed by the plurality of image forming parts, the patch being unfixed;

a second detecting step of detecting by a second detecting part a chromaticity of the patch formed by the plurality of image forming parts, the patch being fixed; and a setting step of setting the calibration table of the image processing part based on a detection result of the first detecting part and a detection result of the second detecting part, in which the setting step includes a step of setting the calibration table corresponding to each of the plurality of speeds based on the detection result of the first detecting part and the detection result of the second detecting part.

Other objects, structures, and effects of the present invention will become apparent upon reading and understanding the following detailed description with reference to the accompanying drawings.

DETAILED DESCRIPTION OF THE PREFERRED EMBODIMENTS

Hereinafter, detailed description is made of a color image forming apparatus according to embodiments of the present invention. Note that the present invention is not limited to a form of an apparatus, and may be realized based on supportive description of the embodiments in forms of: a method; a program for causing the method to be effected; and a storage medium such as a CD-ROM that stores the program.

(Embodiment 1)

Figure 1:
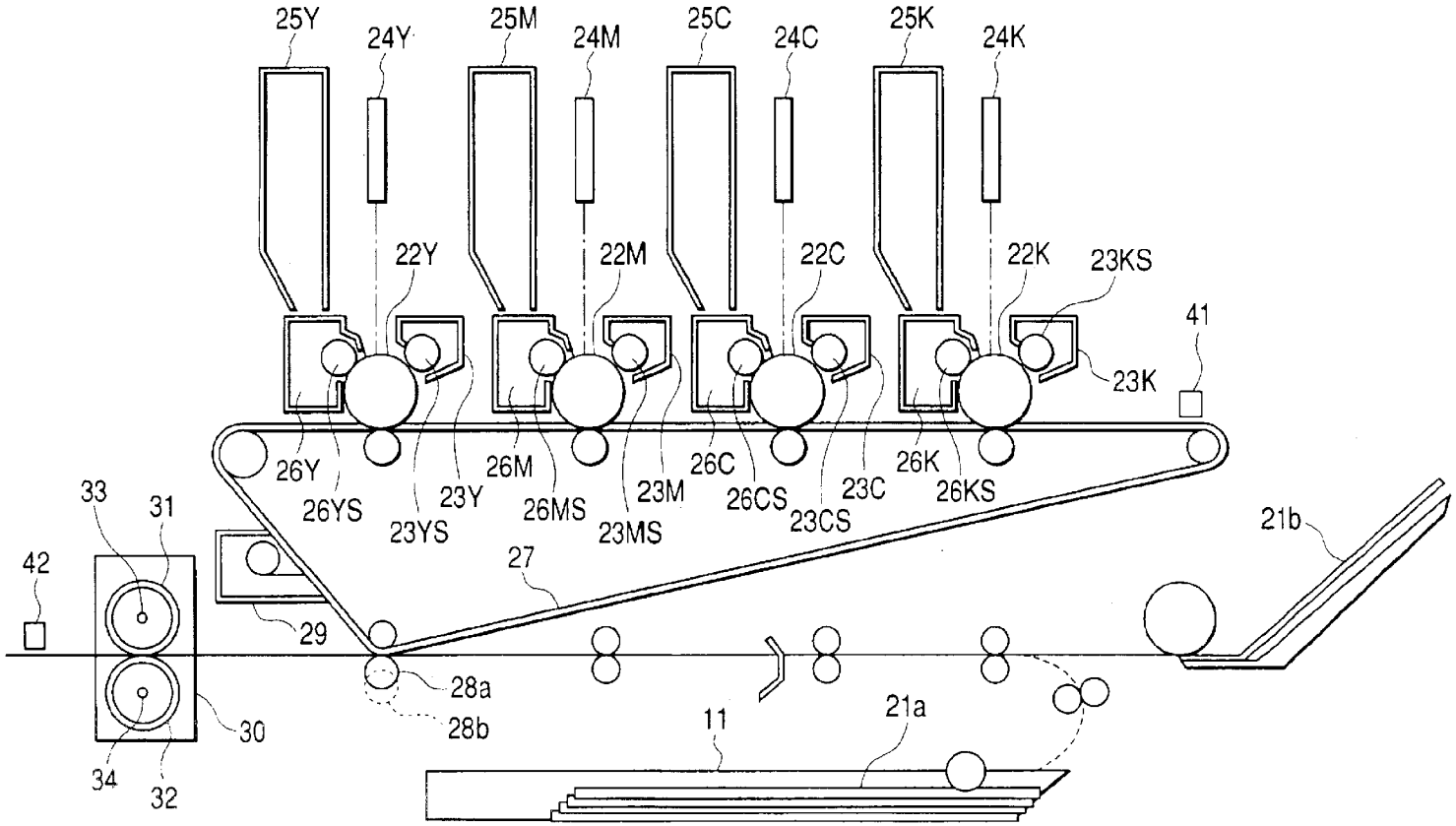
FIG. 1 is a sectional view showing an overall structure of Embodiment 1.

FIG. 1 is a sectional view showing an overall structure of a "color image forming apparatus" according to Embodiment 1. The color image forming apparatus is a color image forming apparatus of a tandem system adopting an intermediate transferring body 27 as shown in FIG. 1, which is an example of a color image forming apparatus of an electrophotographic process. The color image forming apparatus of the present invention is structured by an image forming part as shown in FIG. 1 and an image processing part (not shown).

Figure 13:
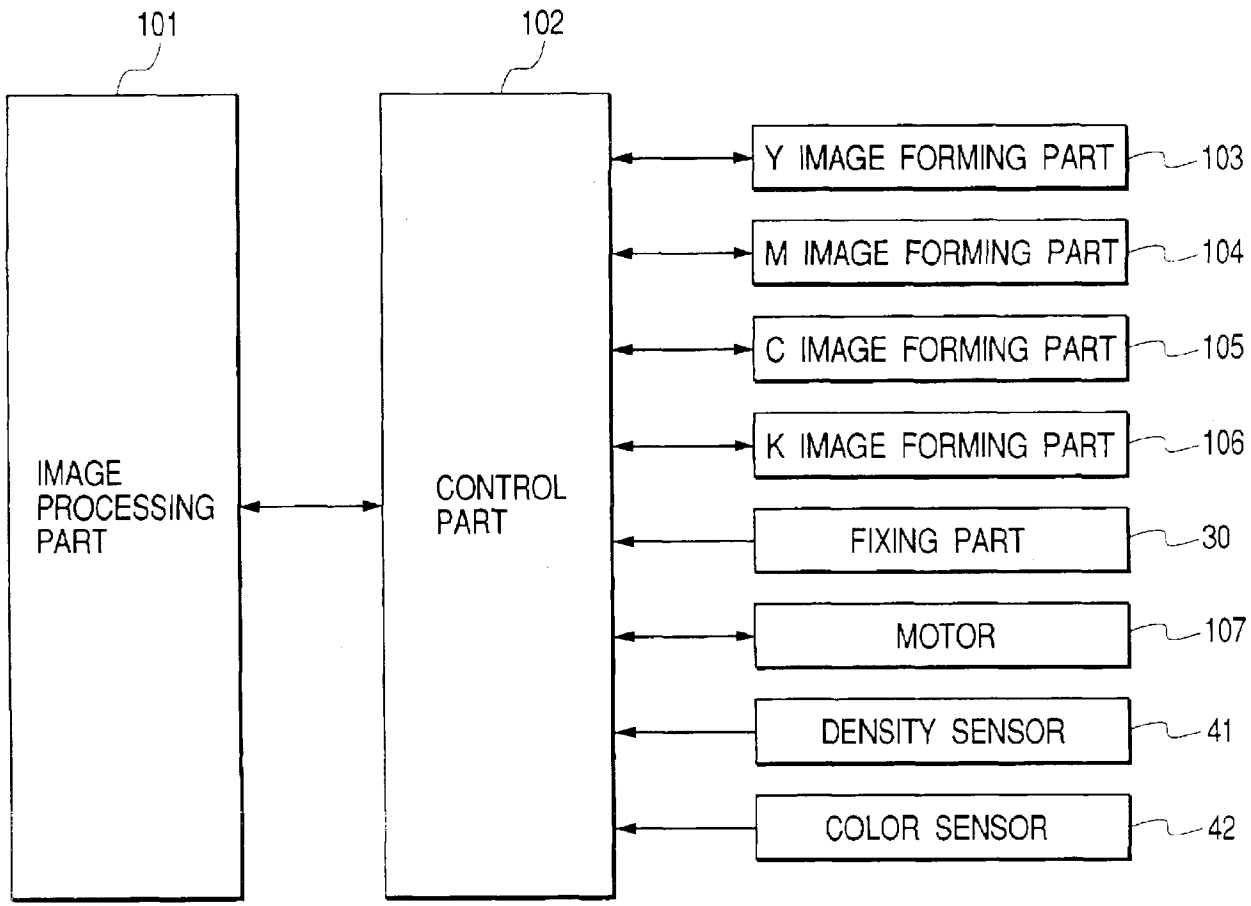
FIG. 13 is a diagram showing an electric control system of a color image forming apparatus.

Next, FIG. 13 is used to describe an electric control system of the color image forming apparatus.

In FIG. 13, an image processing part 101 for generating image data receives a print job from a host computer (not shown) and develops the print job into the image data to be formed in the color image forming apparatus while executing various image processing. Image forming parts 103 to 106 have functions to form images in yellow, magenta, and cyan that are chromatic colors and in black that is an achromatic color, respectively. A fixing part 30 serves to fix the formed images to a transfer sheet. A motor 107 has a function to rotate various rollers for conveying the transfer sheet. A density sensor 41 as a first detecting part and a color sensor 42 as a second detecting part are described later.

Figure 2:
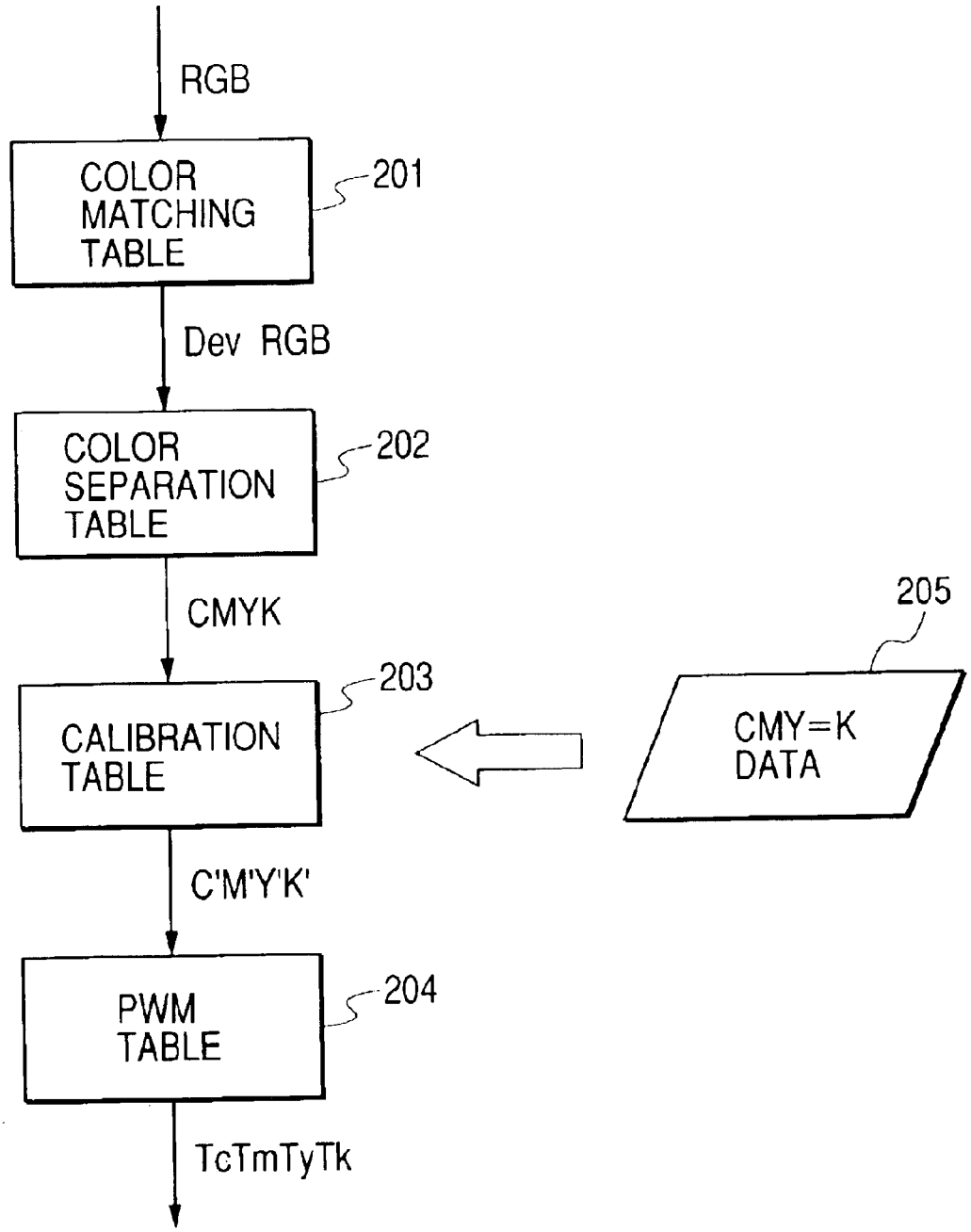
FIG. 2 is a flow chart showing processing in an image processing part.

Next, description is made of processing in the image processing part 101. FIG. 2 is an explanatory diagram showing an example of processing in the image processing part of the color image forming apparatus. An RGB signal representing a color of an image sent from a personal computer or the like based on a color matching table that is prepared is converted into a device RGB signal (hereinafter, referred to as "DevRGB") adapted to a color reproduction gamut of the color image forming apparatus. In step 202, a color separation table that is prepared is used to convert the DevRGB signal into a CMYK signal representing a material color of toner used in the color image forming apparatus.

In step 203, a calibration table for correcting density/gradation characteristics (a relationship between density and gradation), which is inherent to each color image forming apparatus, is used to convert the CMYK signal into a C'M'Y'K' signal corrected with respect to the density/gradation characteristics. In step 204, a pulse width modulation (PWM) table is used to convert the C'M'Y'K' signal into exposure times Tc, Tm, Ty, and Tk for scanner parts 24C, 24M, 24Y, and 24K corresponding to C', M', Y', and K' of the C'M'Y'K' signal, respectively.

Next, FIG. 1 is used to describe an operation of the image forming part in the color image forming apparatus of an electrophotographic process. In the image forming part, electrostatic images are formed using exposure light that is turned on based on the exposure times converted by the image processing part. The electrostatic images are developed to form single-color toner images, then the single-color toner images are overlapped with each other to form a multi-color toner image, and the multi-color toner image is transferred onto and fixed to a transfer material 11. The image forming part includes: a sheet feeding portion 21; photosensitive members (photosensitive drums) (22Y, 22M, 22C, and 22K) in respective stations that are aligned by the number of development colors; injection charger (23Y, 23M, 23C, and 23K) as primary charging means; toner cartridges (25Y, 25M, 25C, and 25K); developing devices (26Y, 26M, 26C, and 26K); the intermediate transferring body 27; a transferring roller 28; cleaning means 29; the fixing part 30; the density sensor 41; and the color sensor 42.

The photosensitive drums 22Y, 22M, 22C, and 22K are each structured by coating an organic photoconductive layer in an outer periphery of an aluminum cylinder, and rotated by a driving force transmitted from a drive motor (not shown). The drive motor rotates the photosensitive drums 22Y, 22M, 22C, and 22K counterclockwise in accordance with an image forming operation.

The four injection chargers 23Y, 23M, 23C, and 23K provided as the primary charging means in the respective stations serve to charge photosensitive bodies of yellow (Y), magenta (M), cyan (C), and black (B), respectively, and are provided with sleeves 23YS, 23MS, 23CS, and 23KS, respectively.

Exposure light is sent to the photosensitive drums 22Y, 22M, 22C, and 22K from the scanner parts 24C, 24M, 24Y, and 24K, respectively, to be used to selectively expose surfaces of the photosensitive drums 22Y, 22M, 22C, and 22K, respectively. Thus, the electrostatic images are formed.

The four developing devices 26Y, 26M, 26C, and 26K provided as developing means in the respective stations serve to perform development in order to visualize the electrostatic latent images of yellow (Y), magenta (M), cyan (C), and black (B), respectively, and are provided with sleeves 26YS, 26MS, 26CS, and 26KS, respectively. The respective developing devices are detachably attached to the image forming part.

The intermediate transferring body 27 is in contact with the photosensitive drums 22Y, 22M, 22C, and 22K, and rotates clockwise at the time of color image forming in accordance with rotation of the photosensitive drums 22Y, 22M, 22C, and 22K, so that the single-color toner images are transferred onto the intermediate transferring body 27. After that, the transferring roller 28 described later is brought into contact with the intermediate transferring body 27, and the transfer material 11 is nipped and conveyed so that the multi-color toner image formed on the intermediate transferring body 27 is transferred onto the transfer material 11.

While transferring the multi-color toner image onto the transfer material 11, the transferring roller 28 abuts against the transfer material 11 in a position indicated by 28*a*, and is spaced apart from the intermediate transferring body 27 to a position indicated by 28*b* after printing processing.

The fixing part 30 melts and fixes the transferred multi-color toner image while conveying the transfer material 11, and includes a fixing roller 31 for heating the transfer material 11 and a pressure roller 32 for bringing the transfer material 11 into press contact with the fixing roller 31. The fixing roller 31 and the pressure roller 32 are formed into hollow shapes and have heaters 33 and 34 built therein, respectively. That is, the transfer material 11 bearing the multi-color image is conveyed by the fixing roller 31 and the pressure roller 32, and applied with heat and pressure, so that the toner is fixed to a surface of the transfer material 11.

After that, the transfer material 11 having the toner image fixed thereto is discharged to a discharge tray (not shown) by a discharge roller (not shown), thereby ending the image forming operation.

The cleaning means 29 cleans the toner remaining on the intermediate transferring body 27. The waste toner produced after transferring the multi-color toner image of four colors formed on the intermediate transferring body 27 onto the transfer material 11 is accumulated in the cleaner container.

Figure 3:
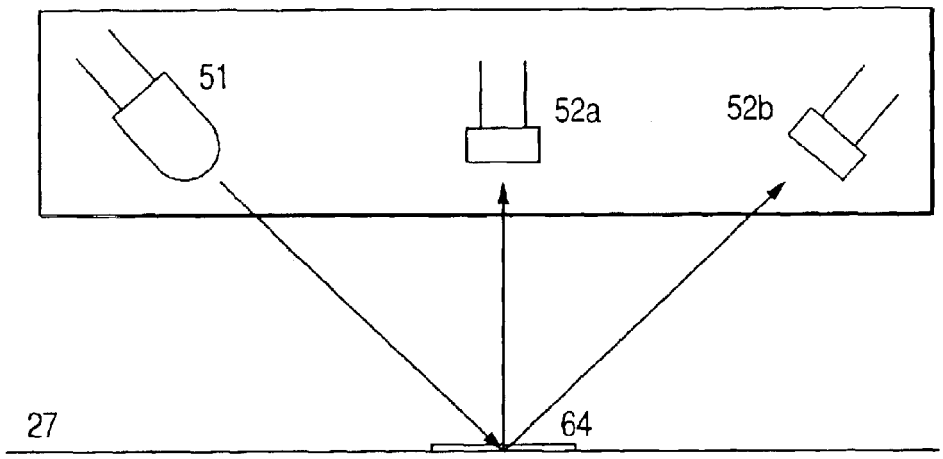
FIG. 3 is a diagram showing a structure of a density sensor.

The density sensor 41 is arranged toward the intermediate transferring body 27 in the color image forming apparatus of FIG. 1, and measures a density of the toner patch formed on the surface of the intermediate transferring body 27. FIG. 3 shows an example of a structure of the density sensor 41. The density sensor 41 is composed of: an infrared light emitting element 51 such as an LED; light receiving elements 52*a* and 52*b* such as a photo diode and Cds; an IC (not shown) that processes data on the received light; and a holder (not shown) that accommodates those components.

The light receiving element 52*a* detects a diffuse reflection light intensity from a toner patch 64, whereas the light receiving element 52*b* detects a direct reflection light intensity from the toner patch 64. By detecting both of the direct reflection light intensity and the diffuse reflection light intensity, a density of the toner patch 64 can be detected from a high density to a low density. Note that an optical element such as a lens (not shown) may be used for connecting the infrared light emitting element 51 and the light receiving elements 52*a* and 52*b*.

Figure 4:
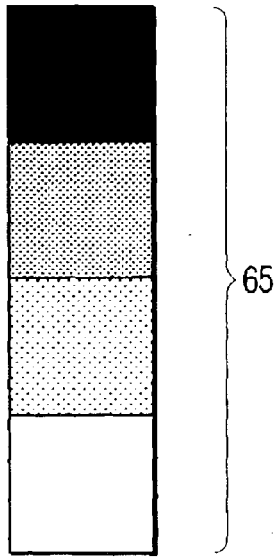
FIG. 4 is a diagram showing a patch pattern for controlling characteristics of a relationship between a density and a gradation.

FIG. 4 shows an example of a density/gradation characteristic control patch pattern formed on the intermediate transferring body 27. A gradation patch 65 of a single color of unfixed K toner is arranged. After that, a gradation patch of a single color of CMY toner (not shown) is subsequently formed. The density sensor 41 cannot distinguish toner color on the intermediate transferring body 27. For this reason, the gradation patch 65 of a single color is formed on the intermediate transferring body 27. Then, this density data is fed back to a calibration table that corrects density/gradation characteristics of an image processing part and to each process condition in the image processing part.

Also, by use of a conversion table that converts a detected density to a color difference with respect to a specific kind of paper, the density sensor 41 can output a color difference with respect to a specific kind of paper only for a patch of a single color of CMYK after conversion. When the density sensor can output a color difference with respect to a specific kind of paper in addition to the density, the density sensor may control color difference/gradation characteristics with respect to the specific kind of paper for the respective CMYK instead of controlling the density/gradation characteristics of the respective CMYK. In this case, all densities in the density/gradation characteristics as described above may be changed to color differences from a specific kind of paper. As a result, gradation characteristics based more on human visual perceptions can be achieved by controlling the color difference/gradation characteristics with respect to the specific kind of paper for the respective CMYK.

In the color image forming apparatus of FIG. 1, the color sensor 42 is arranged on a downstream side of a fixing part 30 of a transfer material conveying path while facing an image forming surface of the transfer material 11. The color sensor 42 detects an RGB output value of a fixed patch of a mixing color formed on the transfer material 11, and is arranged inside the color image forming apparatus. Therefore, the density can be detected automatically before a fixed image is discharged to a discharge part.

Figure 5:
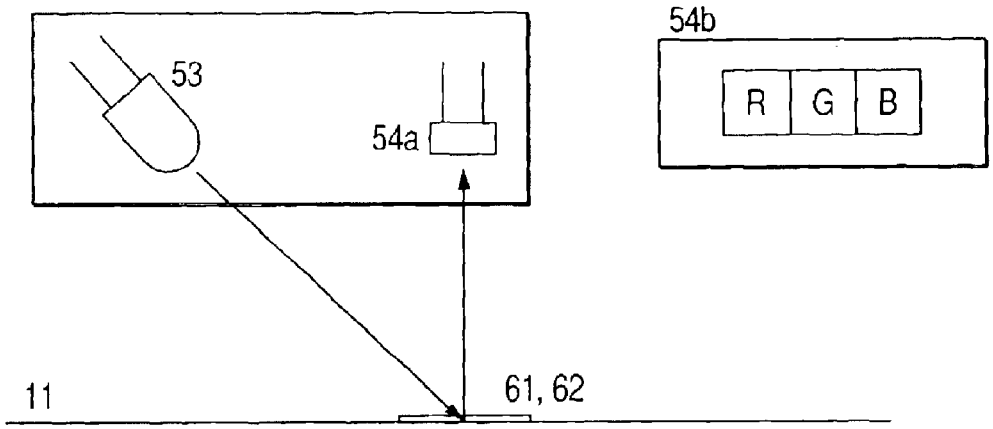
FIG. 5 is a diagram showing a structure of a color sensor.

FIG. 5 shows an example of a structure of the color sensor 42. The color sensor 42 is composed of a white LED 53 and an RGB on-chip filter attached charge accumulating type sensor 54*a*. Light from the white LED 53 enters the transfer material 11 on which the patch is fixed at an angle of 45°, and the RGB on-chip filter attached charge accumulating type sensor 54*a* detects a diffuse reflection light intensity in a direction 0°. A light receiving part of the RGB on-chip filter attached charge accumulating type sensor 54*a* is a pixel in which an RGB is independent like a pixel 54*b*.

The charge accumulating type sensor of the RGB on-chip filter attached charge accumulating type sensor 54*a* may also be a photo diode. The sensor may be formed by arranging a several sets of RGB three pixels. In addition, a structure may be employed in which the incident angle is set to 0°, and the reflection angle is set to 45°. Further, the sensor may be formed of LEDs emitting three colors of RGB and a sensor that does not include a filter.

Figure 6:
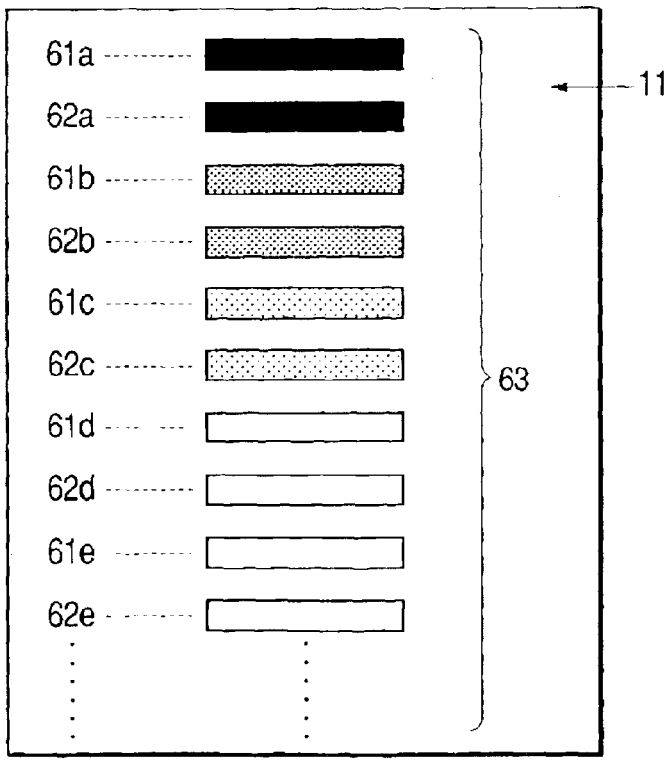
FIG. 6 is a diagram showing a patch pattern for controlling the characteristics of the relationship between a density and a gradation, which is formed on a transfer material.

Here, FIG. 6 shows an example of a fixed density/gradation characteristic control patch pattern formed on the transfer material 11. The density/gradation characteristic control patch pattern is a center of a color reproduction gamut, and is a gradation patch pattern of gray, which is a very important color for adjusting a color balance. The density/gradation characteristic control patch pattern is formed of a gray gradation patch 61 of black (K), and a process gray gradation patch 62 made by mixing cyan (C), magenta (M), and yellow (Y). In the standard color image forming apparatus, the K gray gradation patch 61 and the CMY process gray gradation patch 62 that have close chromaticities to each other are arranged as a pair like 61*a* and 62*a*, 61*b* and 62*b*, and 61*c* and 62*c*. An RGB output value of this patch is detected by the color sensor 42.

When an absolute white color reference is set, it is also possible to calculate an absolute chromaticitiy.

Since the RGB output value changes continuously in accordance with a gradation degree, when the RGB output value of a given gradation degree and that of an adjacent gradation degree are subjected to mathematical processing such as initial approximation and quadratic approximation, an assessed value of the RGB output value between the detected gradation degrees can be calculated. Even when no absolute white color reference is set, and it is impossible to calculate the absolute chromaticitiy, a CMY mixing proportion of the process gray gradation patch made by mixing the three colors of CMY, which has the chromaticity substantially equal to that of the K gray gradation patch at a given gradation degree can be calculated by relatively comparing the RGB output value of the K gray gradation patch and that of the CMY process gray gradation patch.

That is, in a case where the output of means for detecting a color of a fixed patch formed on the transfer material is an output of different three colors, when the output of the different three colors of the process gray gradation patch is equal to that of the gray gradation patch of black, it is determined that the absolute chromaticities of both the patches are equal to each other.

Figure 7:
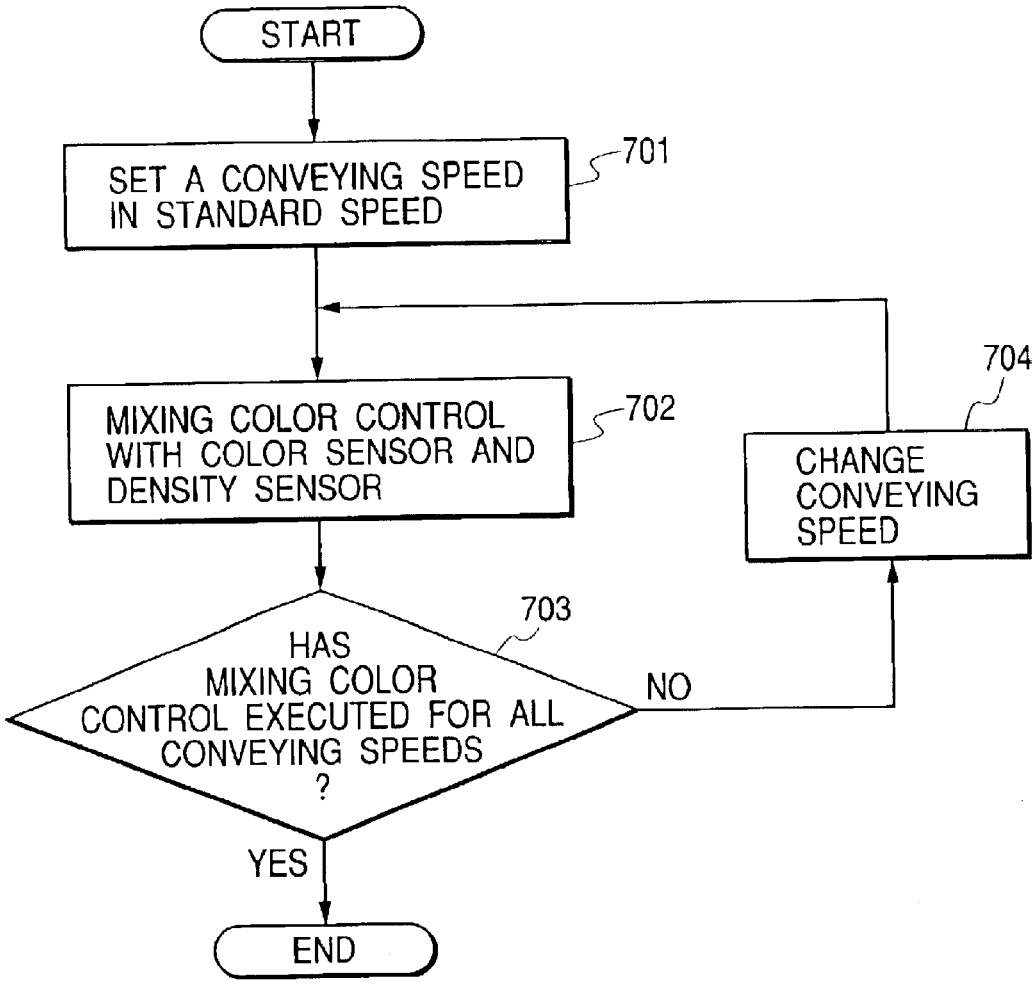
FIG. 7 is a flow chart showing control of characteristics of a relationship between a density and a gradation according to Embodiment 1.

FIG. 7 shows a flow chart indicating a density/gradation characteristic control at each conveying speed with the combination of the color sensor 42 and the density sensor 41 in accordance with this embodiment. Here, the density/gradation characteristic control by use of the color sensor and the density sensor is referred to as mixing color control.

Further, since the transfer material is consumed during the above-mentioned mixing color control, density/gradation characteristic control by appropriately using only the density sensor (hereinafter, referred to as single color control) is executed in intervals between the mixing color controls, thereby realizing control for stabilizing color balance and suppressing the consumption amount of the transfer material.

First, in step 701, a conveying speed is set in standard speed mode.

In step 702, the mixing color control is executed at the standard speed. A calibration table at this time is stored as a standard speed calibration table.

In step 703, it is confirmed whether or not the mixing color control is executed for all the conveying speeds which can be set in the image forming apparatus. For example, in a case where the standard speed mode and the half speed mode can be set in the image forming apparatus, and when the mixing color control is executed only at the standard speed mode, the processing advances to step 704.

In step 704, the setting is changed to a conveying speed at which the mixing color control has not yet been executed, in this example, the half speed mode. Thereafter, the mixing color control is executed at the half speed mode in step 702. A calibration table at this time is stored as a half speed calibration table.

As described above, the mixing color control is executed sequentially for the respective conveying speeds, and when the mixing color control is completed for all the conveying speeds which can be set in the image forming apparatus, the sequence ends.

In this example, the mixing color control is executed for the standard speed mode and the half speed mode in this order, but the order is not necessarily limited thereto. When the mixing color control can be executed for all the conveying speeds, the mixing color control may be executed in any order.

Further, in this example, as the conveying speeds, there are only the standard speed mode and the half speed mode, but the conveying speeds are not necessarily limited to the above two speed modes. The mixing color control can be realized in an image forming apparatus having plural conveying speeds such as high gloss mode, one third speed mode, and quarter speed mode. The mixing color control may be executed sequentially for those modes.

The mixing and single color controls are executed at intervals between the normal printing operations. That is, the controls are executed automatically at the timing set in advance, such as at the time of a power ON state for color image forming apparatus, after forming images for predetermined sheets of paper, after detection of a predetermined environmental variation, or at the time of replacement of consumable parts. Alternatively, the controls are executed manually when the user desires to execute. The predetermined number of executing the single color control is set in advance. Note that, when a condition change of the color image forming apparatus occurs, such as power ON state for color image forming apparatus, environmental variation, and replacement of consumable parts, the processing may be returned to the mixing color control even before executing a predetermined number of the single color control.

Figure 8:
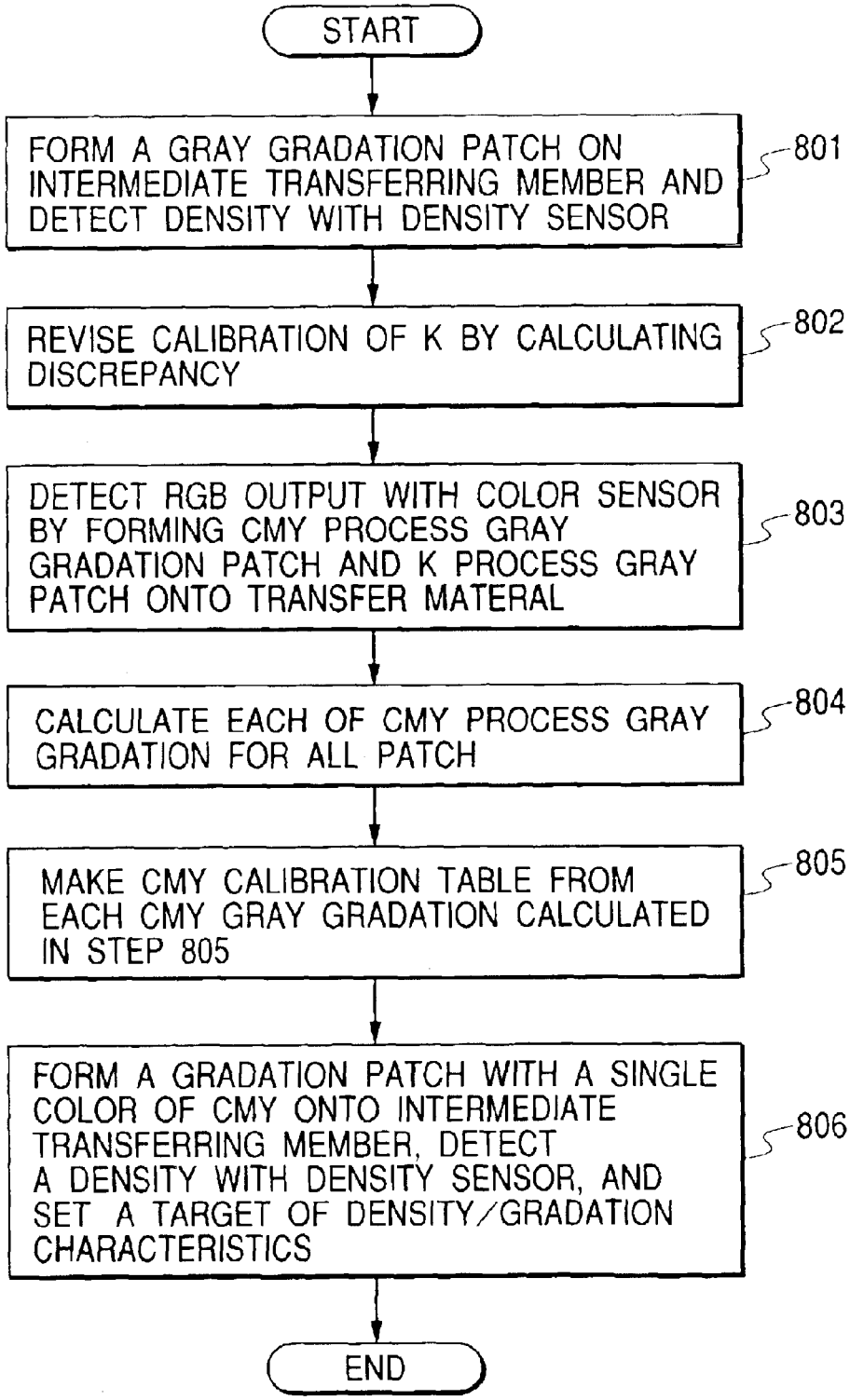
FIG. 8 is a detailed flow chart showing mixing color control according to Embodiment 1.

FIG. 8 shows a flow chart indicating the detail of the density/gradation characteristic control by the above-mentioned mixing color control.

First, a target of the density/gradation characteristics by the mixing color control of black (K) is set in advance. This target is set when the image processing part of the color image forming apparatus is designed or when the apparatus is shipped.

In step 801, a K gray gradation patch is formed on the intermediate transferring body, and the density is detected with the density sensor.

In step 802, a discrepancy is calculated between the density/gradation characteristics of the detected K gray gradation patch and the target of the density/gradation characteristics set in advance, and the calibration table of K that corrects the density/gradation characteristics of the image processing part is revised to return to the target.

Figure 9:
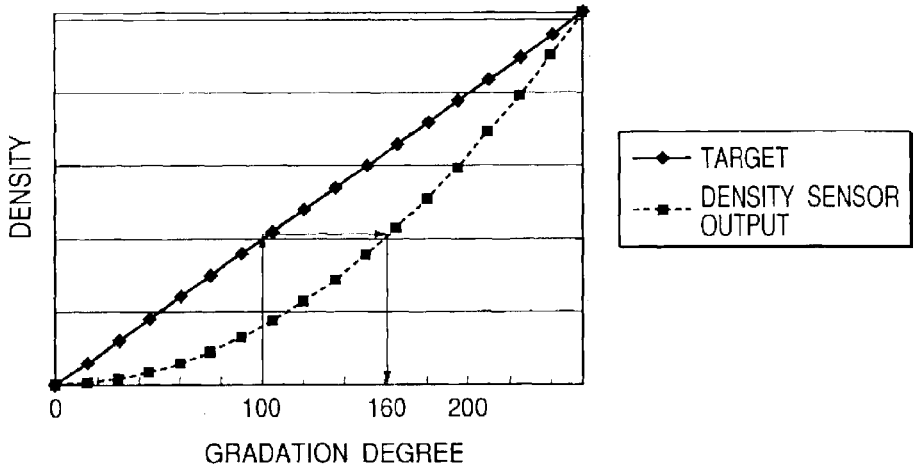
FIG. 9 is a diagram for explaining a procedure for revising a calibration table of an image processing part.

While referring to FIG. 9, a revising method for the calibration table in step 802 is described. For example, in a 255-grayscale color image forming apparatus, with respect to a density target having a gradation degree of 100, a density sensor output actually obtained is lower than the density target. To obtain the same density, it is conceivable that a gradation degree of 160 needs to be set. Therefore, the calibration table may be revised in such a manner that K100 is converted to K'160. This operation is repeated for plural gradation degrees to revise the calibration table. Note that, in FIG. 9, the relation between the gradation degree and the target density is linear, but the relation does not need to be linear.

Next, in step 803, a fixed density/gradation characteristic control pattern with a K gray gradation patch and a CMY process gray gradation patch formed on the transfer material is outputted, and after passing through the fixing apparatus 30, an RGB output of the patch is detected with the color sensor 42. At the time of the gray gradation patch formation, the calibration table revised only in K in step 802 is utilized. The patch of CMY is not used.

In step 804, from the RGB output values of the K gray gradation patch and the CMY process gray gradation patch detected in step 803, by use of the RGB output changing continuously in accordance with a gradation degree, a CMY gray gradation degree of the CMY process gray gradation that has the chromaticity equal to that of the K gray gradation patch at each gradation degree is detected for all patches. Even when the chromaticities are not completely equal to each other, an allowable color difference is set in advance, and it may be determined that the equal chromaticities are obtained within the allowable color difference.

In step 805, a CMY calibration table is mage from the CMY gray gradation degree calculated in step 804. The method of making the table is as follows. In a case where, for example, the CMY gradation degree of the CMY process gray gradation patch that has the chromaticity equal to that of the K gray gradation patch with the gradation degree of 100 formed in step 803, corresponds to C140, M120, and Y80, the calibration table of C is made so as to convert C100 to C'140. Then, the calibration table of M is made so as to convert M100 to M'120, and the calibration table of Y is made so as to convert Y100 to Y'140. Similarly, the same process is executed for other gradation degrees of the gray gradation patch, thereby completing the CMY calibration table.

In step 806, by use of the CMY calibration table made in step 805, an unfixed density/gradation characteristic control patch pattern is formed onto the intermediate transferring body with a gradation patch of a single color of CMY, a density is detected with the density sensor, and the detected density/gradation characteristics is set to the target of the density/gradation characteristics of CMY.

Figure 10:
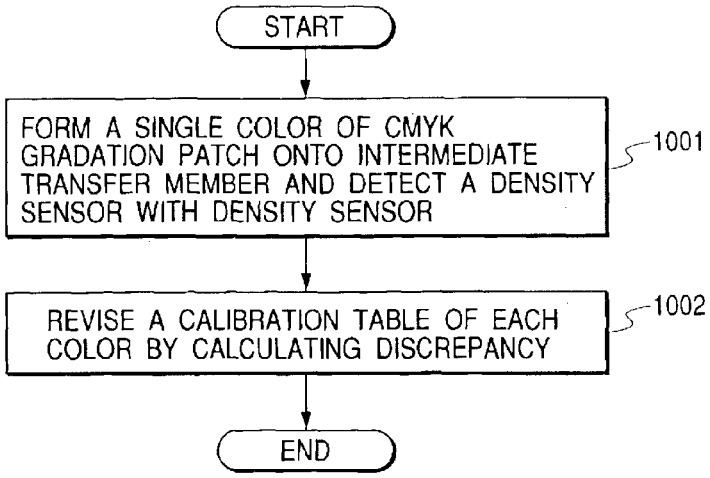
FIG. 10 is a detailed flow chart showing a single color control according to Embodiment 1.

FIG. 10 shows a flow chart indicating the detail of the above-mentioned density/gradation characteristic control in accordance with the single color control.

In step 1001, a gradation patch of a signal color of CMYK is formed onto the intermediate transferring body, and a density is detected with the density sensor.

In step 1002, by calculating the discrepancy between the target of the density/gradation characteristics of K set in advance and the target of the density/gradation characteristics of CMY made in step 805, a calibration table of each color is revised to return to the target. This revising method for each color of CMYK has the same revising process for the calibration table of K executed in step 802.

When the density sensor can output a color difference with respect to a specific kind of paper in addition to the density, the density sensor may control color difference/gradation characteristics with respect to the specific kind of paper instead of controlling the density/gradation characteristics. In this case, all the densities in a main control may be changed to color differences from a specific kind of paper. As a result, gradation characteristics based more on human visual perceptions can be achieved.

When the color sensor can output an absolute chromaticity, by using absolute chromaticities of the K gray gradation patch and the CMY process gray gradation patch in step 804, a CMY gradation degree of the process gray gradation that has the same chromaticity may be calculated.

In a state where the control described above is executed, when a print command is issued from the host computer or the like, according to the set conveying speed, the image forming apparatus performs image forming by selectively switching the calibration tables for the respective conveying speeds.

As described above, according to this embodiment, the mixing color control is executed for all the conveying speeds at predetermined timings, the calibration tables are made, and the image forming is performed by using the calibration table that corresponds to the respective conveying speeds during the print process. As a result, the color image forming apparatus can be provided which realizes the stable color balance at any conveying speed.

(Embodiment 2)

Figure 11:
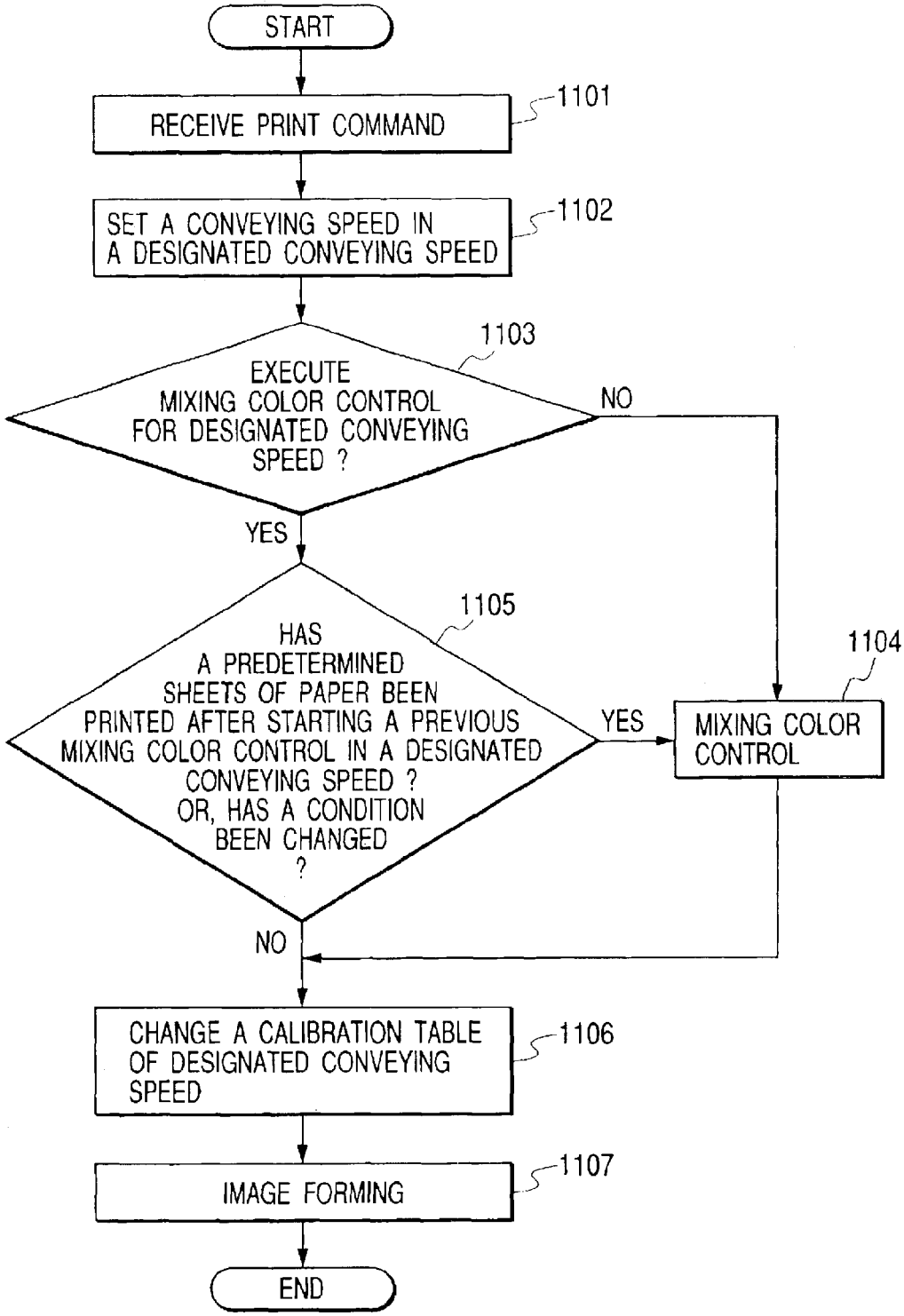
FIG. 11 is a flow chart showing control of characteristics of a relationship between a density and a gradation according to Embodiment 2.

FIG. 11 shows a flow chart indicating the detail of a density/gradation characteristic control in accordance with Embodiment 2. This embodiment is different from Embodiment 1 in that the density/gradation characteristic control is not executed for all the conveying speeds at once, but the density/gradation characteristic control is executed only when the density/gradation characteristic control is not executed at a conveying speed designated during the print process.

In step 1101, an image forming apparatus receives a print command from a host computer or the like, and in step 1102, the apparatus sets a conveying speed to a conveying speed designated by the print command.

In step 1103, it is determined whether or not the mixing color control is executed for the conveying speed designated by the print command. When the control is not executed, the mixing color control is executed in step 1104.

In a case where the mixing color control is executed for the designated conveying speed, it is determined whether or not predetermined sheets of paper have been printed after starting a previous mixing color control at a conveying speed designated in step 1105 or a condition change occurs such as power ON state, environmental variation, or replacement of consumable parts in the color image forming apparatus. When at least one of the above events occurs, the processing advances to step 1104 to execute the mixing color control.

When none of the above events occurs, or after the mixing color control is executed when one of the events occurs, a calibration table for a conveying speed designated in step 1106 is set.

After executing the above operations, an image is formed in step 1107.

As described above, according to this embodiment, in addition to the effects of Embodiment 1, the color image forming apparatus can be provided which minimizes the time period required for the density/gradation characteristic control by executing the density/gradation characteristic control as a need is met, and can form an image without keeping the user waiting unnecessarily.

(Embodiment 3)

Figure 12:
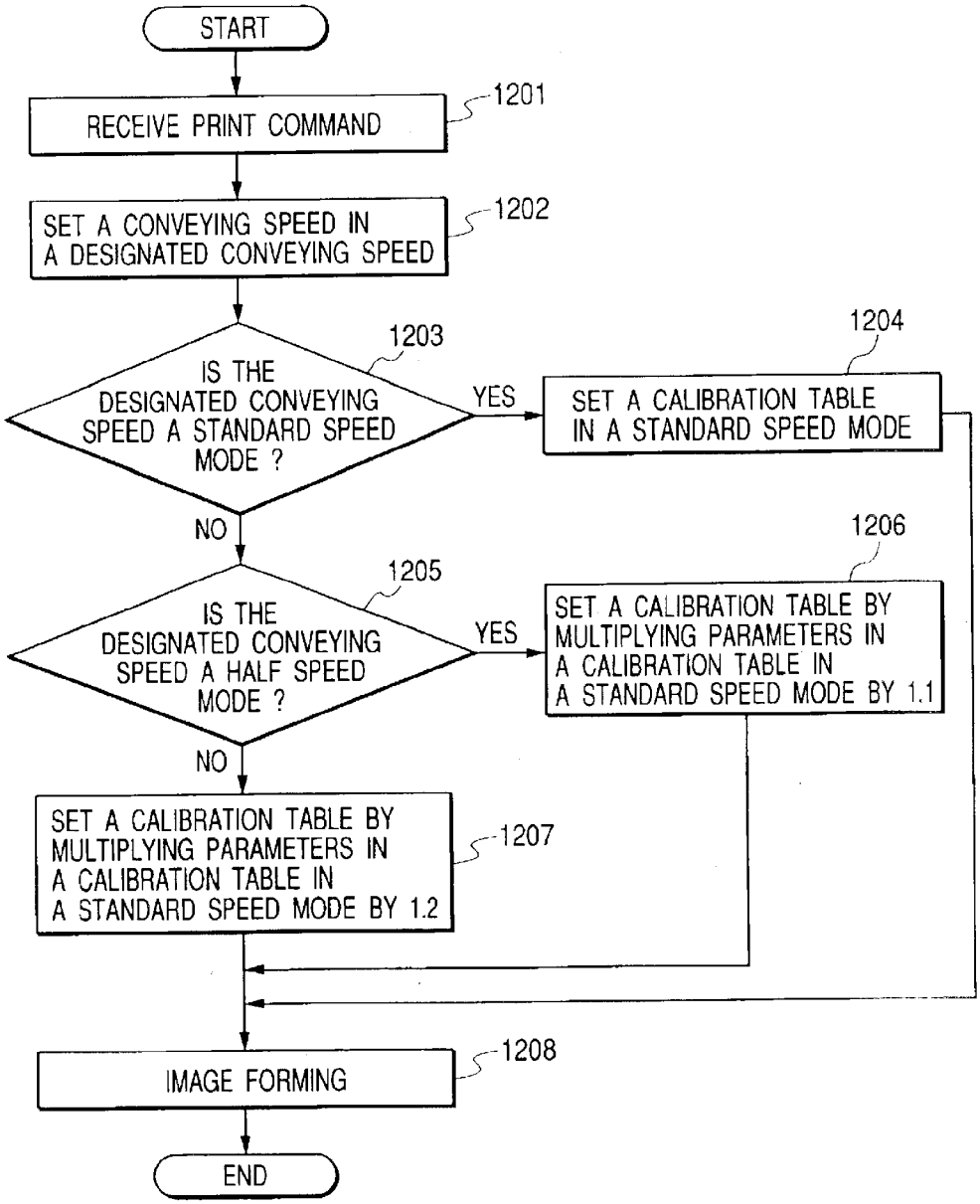
FIG. 12 is a flow chart showing control of characteristics of a relationship between a density and a gradation according to Embodiment 3.

FIG. 12 shows a flow chart indicating the detail of a density/gradation characteristic control in accordance with Embodiment 3. This embodiment is different from Embodiment 1 and Embodiment 2 in that based on a calibration table of a reference conveying speed, calibration tables for other conveying speeds are made.

First, a mixing color control in a standard speed mode is executed. A calibration table at this time is stored as a standard speed calibration table. After that, it is determined whether or not predetermined sheets of paper have been printed after starting a previous mixing color control or a condition change occurs such as power ON state, environmental variation, or replacement of consumable parts in the color image forming apparatus. The mixing color control is executed sequentially as needed to revise the standard speed calibration table.

While following FIG. 12, operations during a print process according to this embodiment will be described below.

First, in step 1201, an image forming apparatus receives a print command from a host computer or the like, and in step 1202, the apparatus sets a conveying speed to a conveying speed designated by the print command.

In step 1203, it is determined whether or not the conveying speed designated by the print command is a conveying speed in a standard speed mode. In a case of the conveying speed in the standard speed mode, the above-mentioned standard speed calibration table is set in step 1204.

When the designated conveying speed is not the standard speed mode, it is determined in step 1205 whether or not the designated conveying speed is a half speed mode. In a case of the half speed mode, a calibration table is set in step 1206 by multiplying each standard speed calibration table described above by a coefficient of 1.1 that has been set in advance before the image forming apparatus is shipped. Description is given by use of a specific example. In a case where a density target of a certain color has a gradation degree of 100, and conversion is executed in such a manner that the gradation degree becomes 120 in order to obtain the same density by using the standard speed calibration table, the standard speed calibration table is set so as to increase the gradation degree by +20 at the time of issuing a command of the gradation degree of 100. Here, in a half speed calibration table, conversion of +22, which is found by multiplying +20 by 1.1, is executed. Therefore, the gradation degree becomes 122 after the conversion.

In this example, an image forming apparatus is taken as an example for the explanation, which shows characteristics in which a change in the gradation degree becomes larger in the half speed mode than the standard speed mode, and the coefficient is set to 1 or larger. However, it is not necessary to set similarly. In a case where the change in the gradation degree becomes smaller when the conveying speed is changed, the case can be coped with without problems by setting the coefficient to 1 or smaller.

When the designated conveying speed is not the half speed mode, for example, a quarter speed, a high gross mode, or the like, a calibration table is set in step 1207 by multiplying each standard speed calibration table described above by a coefficient of 1.2 that has been set in advance before the image forming apparatus is shipped. Similar to the previous example, conversion of +24, which is found by multiplying +20 by 1.2, is executed, and the gradation degree becomes 124 after the conversion.

After executing the above operations, an image is formed in step 1208.

Here, an example is taken for the explanation in which the coefficient has been set in advance before the image forming apparatus is shipped, but it is not limited thereto. For example, at the time of a power ON state or the like, the mixing color control is executed for all the conveying speeds. From the detection result at this time, differences or ratios between the calibration tables at the respective speeds are calculated. After that, those values are utilized to make calibration tables for other conveying speeds from the standard speed calibration table.

Here, an example is taken for the explanation in which the calibration table at a reference conveying speed is multiplied by a coefficient, but it is not limited thereto. As long as the calibration table is made from the calibration table at the reference conveying speed, any method can be employed. For example, a method may be used in which gradation degrees converted with the standard speed calibration table are equally added by +5. In this case, the gradation degree of 100 is converted with the standard speed calibration table to 120 according to the previous example. The gradation degree is then added by +5 and therefore becomes 125.

Furthermore, in this example, the reference conveying speed is set in the standard conveying mode, but it is not limited thereto. A different speed mode, the half speed mode for example, can be set as the reference.

As described above, according to this embodiment, based on the calibration table of the reference conveying speed, the calibration tables for other conveying speeds are made. As a result, in addition to the effects of Embodiment 1 and Embodiment 2, the density/gradation characteristic control suitable for all the conveying speeds can be executed in a shorter period of time. Thus, the color image forming apparatus capable of forming an image without keeping the user waiting can be provided.

According to the embodiments described above, in the color image forming apparatus that uses the combination of the color sensor and the density sensor, the density/gradation characteristic control is executed at each conveying speed of the transfer material, which is superior to the conventional density/gradation characteristic control by only using the single conveying speed. As a result, it is possible to attain the stable color balance at any conveying speed.

What is claimed is:

1. A color image forming apparatus, comprising:

an image processing part that is suitable for processing image data based on a calibration table;

a plurality of image forming parts that are suitable for forming an image using different colors from each other based on the image data outputted from the image processing part;

a conveying part that can convey at any one of a plurality of speeds a transfer material onto which the image formed by the plurality of image forming parts is transferred;

a fixing part that is suitable for subjecting the transfer material conveyed by the conveying part to fixing processing;

a first detecting part that is suitable for detecting a density of a patch formed by the plurality of image forming parts, the patch being unfixed;

a second detecting part that is suitable for detecting a chromaticity of the patch formed by the plurality of image forming parts, the patch being fixed; and a setting part is suitable for revising the calibration table of the image processing part based on a detection result of the first detecting part and a detection result of the second detecting part, wherein the image processing part stores the calibration table corresponding to each of the plurality of speeds; and wherein the setting part sets the calibration table corresponding to each of the plurality of speeds based on the detection result of the first detecting part and the detection result of the second detecting part.

2. A color image forming apparatus according to claim 1, wherein the first detecting part detects a density of a patch formed on the conveying part; and wherein the second detecting part detects a chromaticity of a patch formed on the transfer material conveyed by the conveying part.

3. A color image forming apparatus according to claim 1, wherein the setting part sets the calibration table corresponding to each of the plurality of speeds based on a detection result relating to the patch formed at each of the plurality of speeds.

4. A color image forming apparatus according to claim 1, wherein the first detecting part and the second detecting part set a plurality of calibration tables respectively corresponding to the plurality of speeds based on a detection result relating to the patch formed at a predetermined speed of the plurality of speeds.

5. A color image forming apparatus according to claim 1, wherein the patch is automatically formed at a predetermined timing.

6. A color image forming apparatus according to claim 5, wherein the predetermined timing is determined based on any one of an image forming count value, a power ON state, environmental variation, and replacement of a consumable part.

7. A color image forming apparatus according to claim 1, wherein the plurality of image forming parts includes a plurality of chromatic-color image forming parts for forming a chromatic-color image and a single achromatic-color image forming part for forming an achromatic-color image; and wherein, based on the detection result of the second detecting part, the setting part controls the chromaticity of the patch, which is formed by the plurality of chromatic-color image forming parts and exhibits gray by mixing colors, to be equal to a chromaticity of a patch formed by the single achromatic-color image forming part.

8. A control method for a color image forming apparatus that includes:

an image processing part that is suitable for processing image data based on a calibration table;

a plurality of image forming parts that are suitable for forming an image using different colors from each other based on the image data outputted from the image processing part;

a conveying part that can convey at any one of a plurality of speeds a transfer material onto which the image formed by the plurality of image forming parts is transferred; and a fixing part that is suitable for subjecting the transfer material conveyed by the conveying part to fixing processing, the image processing part storing the calibration table corresponding to each of the plurality of speeds, the control method comprising:

a first detecting step of detecting by a first detecting part a density of a patch formed by the plurality of image forming parts, the patch being unfixed;

a second detecting step of detecting by a second detecting part a chromaticity of the patch formed by the plurality of image forming parts, the patch being fixed; and a setting step of setting the calibration table of the image processing part based on a detection result of the first detecting part and a detection result of the second detecting part, wherein the setting step includes a step of setting the calibration table corresponding to each of the plurality of speeds based on the detection result of the first detecting part and the detection result of the second detecting part.

* * * * *